United States Patent [19]

Shimizu et al.

[11] 4,312,597

[45] Jan. 26, 1982

[54] PRINTER

[75] Inventors: Munetaka Shimizu, Kawagoe; Hiroyuki Harada, Kawaguchi, both of Japan

[73] Assignee: Copal Company Limited, Tokyo, Japan

[21] Appl. No.: 956,360

[22] Filed: Oct. 31, 1978

[30] Foreign Application Priority Data

| | | | |
|---|---|---|---|
| Nov. 6, 1977 | [JP] | Japan | 52/132926 |
| Nov. 6, 1977 | [JP] | Japan | 52/132927 |
| Nov. 6, 1977 | [JP] | Japan | 52/132928 |
| Nov. 6, 1977 | [JP] | Japan | 52/132929 |
| Nov. 6, 1977 | [JP] | Japan | 52/132930 |
| Dec. 29, 1977 | [JP] | Japan | 52/176774[U] |

[51] Int. Cl.[3] ..... B41J 13/02

[52] U.S. Cl. ..... 400/621; 101/224; 83/530

[58] Field of Search ..... 400/621, 593, 608, 589; 101/93.07, 117, 224, 226, 227, DIG. 19; 83/523, 529, 530, 575, 613, 861–863, 866, 879–881, 51, 53, 66

[56] References Cited

U.S. PATENT DOCUMENTS

| | | | |
|---|---|---|---|
| 3,774,530 | 11/1973 | Woodie et al. | 101/224 X |
| 3,850,068 | 11/1974 | Bradam | 83/529 |

FOREIGN PATENT DOCUMENTS

| | | | |
|---|---|---|---|
| 1379419 | 7/1975 | United Kingdom | 83/530 |

*Primary Examiner*—E. H. Eickholt

*Attorney, Agent, or Firm*—Oblon, Fisher, Spivak, McClelland & Maier

[57] ABSTRACT

The printer includes a slide member adapted to be reciprocally moved by a drive source. The printer comprises a paper cutting member reciprocally movable for cutting the printed paper, a connecting member connected to the paper cutting member and arranged so as to be engaged with and disengaged from the slide member, and an electromagnetic device adapted to be actuated by a paper cutting signal for controlling the engagement and disengagement of the connecting member with and from the slide member, to thereby permit the cutting member to be engaged by the slide member by the electromagnetic device when activated by the paper cutting signal so as to actuate the slide member for operating the paper cutting member.

3 Claims, 5 Drawing Figures

PRINTER

BACKGROUND OF THE INVENTION

This invention relates to a printer.

In a prior art printer having a printing ribbon feed device, a paper feed device, a stamping device and a paper cutting device, the stamping and paper cutting devices are designed to be operated through a lever device operated by a plunger after a predetermined printing operation on a rolled paper has completed, but the prior art printer requires s relatively high force for cutting the paper and accordingly, the plunger is required to be large in size and have a high operation force. As a result, the printer has the disadvantages that the devices of the printer are inevitably large in size and consume a great deal of power and that delay occurs in operation phase due to increase in inertia force as the result of increase in size of the plunger leading to inefficient operation.

And in a further prior art printer having a printing ribbon feed device, a paper feed device and a paper cutting device and designed to form a perforated line in a predetermined position on a rolled paper and cut the paper after a printing operation has completed on the paper, the paper cutting device is operated through an operation lever operated by an operation plunger, the operation range of the paper cutting device is normally limited by a switching lever designed to limit the operation range of the operation lever to prevent the paper cutting and form a perforated line on the paper and when the paper is to be cut, a switching plunger connected to the switching lever is operated to move the switching lever from the position in which the operation range of the operation lever is limited to cause the operation lever to operate the paper cutting device to thereby cut the paper. However, the prior art printer of this type requires a high force for cutting the paper and has to increase the force of the operation lever resulting in increase in the size, increase in power consumption and increase in inertia force of the operation plunger to lead delay in operation.

In a further prior art printer having a printing ribbon feed device, a paper feed device, a stamping device and a paper cutting device and designed to form a perforated line in a predetermined printing position on a rolled paper and stamp on and cut the paper at the completion of the printing operation, the stamping device and paper cutting device are interlocked with a stamping lever adapted to be operated by a stamping plunger, the stamping device and paper cutting device are operated by the operation of the stamping lever, a switching lever is provided to normally limit the operation range of the stamping lever to thereby limit the operation range of the stamping device and paper cutting device so as to form a perforated line on a paper while preventing the stamping and cutting of the paper and when the stamping and cutting operations are to be preformed, a switching plunger connected to the switching lever is operated to move the switching lever from the stamping lever operation range limit position to cause the stamping lever to operate the stamping device and putting device which in turn perform the stamping and cutting operation, respectively. However, the prior art printer of this type has the disadvantage that a high force is required in the paper cutting and the plunger is required to have a high operation force which inevitably increases the size, power consumption and inertia force of the stamping plunger resulting in delay in operation.

In a further prior art printer having a paper cutting device adapted to be selectively operated by a switching lever so as to form a perforated line in a predetermined position on a rolled paper and cut the paper at a predetermined point after the completion of a predetermined printing operation on the paper and a single bill paper holding-down lever ensures a stabilized printing on a single bill paper blank, separate drive plungers are provided for individually drive the paper cutting device, switching lever and bill paper holding-down lever, respectively and the operation of the components of the printer is controlled by the control circuit of the printer. However, the prior art printer of this type has the disadvantage that the printer is large and complicate in its construction an the operation of the printer is unstable.

In a further prior art printer having a paper cutting device adapted to be selectively operated by a switching lever for forming a perforated line in a predetermined printing position on a rolled paper and cutting the paper at a predetermined point after the completion of a printing operation and a control circuit is provided for so controlling the printer that a printing is performed on a single bill paper held in a stabilized condition and the printing on the single bill paper is prevented when the paper is not inserted in a predetermined or proper position in the printer, separate drive plungers are provided for the paper cutting device, switching lever and paper holding-down lever, respectively and the operation of the components of the printer is controlled by the control circuit of the printer. However, the prior art printer of this type is complicate and large in construction and unstable in operation and especially, the printer tends to erroneously print on the single bill paper when the paper is not inserted in a proper printing position.

In a further prior art printer, the cutting device adapted to cut or form a perforated line on a paper after the paper has been paid out of a roll and printed thereon has a cutter blade adapted to reciprocally move for cooperating with a slit in a cutter receiving member and is provided with teeth for cutting the paper or forming the perforated line on the paper held on a paper support plate depending upon the advancing amount of the cutter blade into the slit, the cutter blade is supported on a reciprocally movable holder operatively connected to a cutter operation lever, and as the cutter operation lever is rocked in the advancing direction by an energization means to cut the paper or form the perforated line on the paper to advance the cutter blade into the slit and the cutter blade is retracted out of the slit under the force of a spring as the cutter operation lever is rocked in the retracting direction ready for feeding the paper for a next printing cycle. However, in the prior art printer referred to just above, when the paper is cut or especially, formed the perforated line thereon, a sagging portion or portions of the paper advance into the slit as the cutter blade advances into the slit to thereby clog up the slit and thus, when the cutter blade is retracted out of the slit under the force of a spring, the force of the spring is insufficient to retract the cutter blade sufficiently because the paper sagging portion or portions clog up the slit and restrain the blade in the slit to thereby make it difficult or impossible to feed the paper for the next printing cycle.

SUMMARY OF THE INVENTION

Therefore, one object of the present invention is to provide an improved printer of the above-mentioned type which eliminates the disadvantages inherent in the prior art printer and includes a paper cutting mechanism in which a reciprocally movable slide plate is provided for operating the paper feed device and ribbon feed device and the paper cutting device is operatively interlocked with the slide plate so that the cutting device is operated by the utilization of a high operation force of the slide plate.

Another object of the present invention is to provide a printer which includes a compact, efficient and less power consumption stamping, paper cutting and perforated line formation mechanism in which the perforated line formation is performed by the utilization of the movement of the slide plate without depending upon a plunger while preventing the stamping by the stamping device in response to the operation of the stamping lever and the cutting of the paper by the paper cutting device.

The above-mentioned objects of the present invention can be attained by providing the construction of a printer as described herein and set forth in the appended claims.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENT

The present invention will be now described referring to the accompanying drawings in which a printer incorporating features of the present invention is shown.

Figure 1:
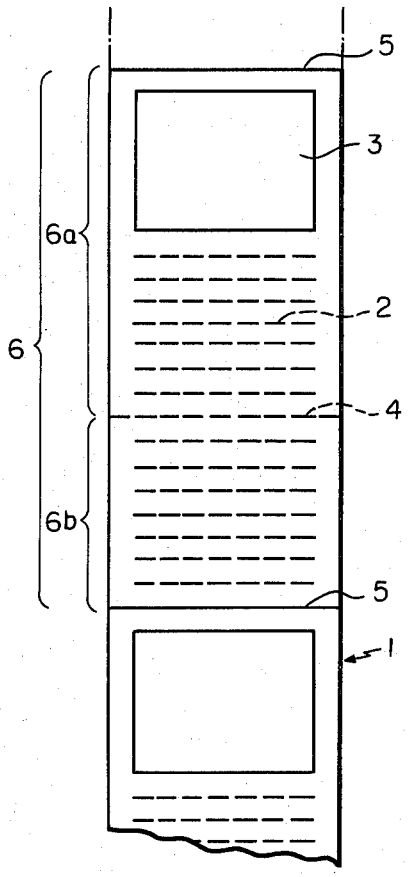
FIG. 1 is a fragmentary plan view showing the printed side of a receipt paper blank processed by a printer.

First referring to FIG. 1, there is shown a printed receipt paper 6 severed at the severing line 5 from the remaining portion of a receipt blank 1. The printed receipt paper 6 has necessary informations 2 printed in a substantial portion thereof, a minor stamped portion 3 and a perforated line 4 positioned in the center of the printed portion 2. In use, the printed receipt paper 6 is severed at the perforated line 4 to divide the receipt paper into the leading receipt portion **6*a* which is to be delivered to a customer and the trailing receipt portion 6*b* which is to be processed in a shop or store. After the severance of the printed receipt paper 6 from the remaining receipt blank 1, the receipt blank is held in the printer with the stamp receiving area in the succeeding unprinted receipt section of the blank positioned at the leading and in the next printing operation, necessary informations 2 are printed in the area immediately following the stamp receiving area and then provided in the center of the printed area 2 with a new perforated line 4 to divide the printed area into the receipt portion 6*a* for a customer and the receipt portion 6*b* for processing in the shop or store the trailing edge of which is defined by the next severing line 5 and the thus processed succeeding receipt 6 is then severed at the severing line 5. By repeating the procedure, a plurality of receipt papers 6 are in succession obtained from the receipt blank 1**.

Figure 2:
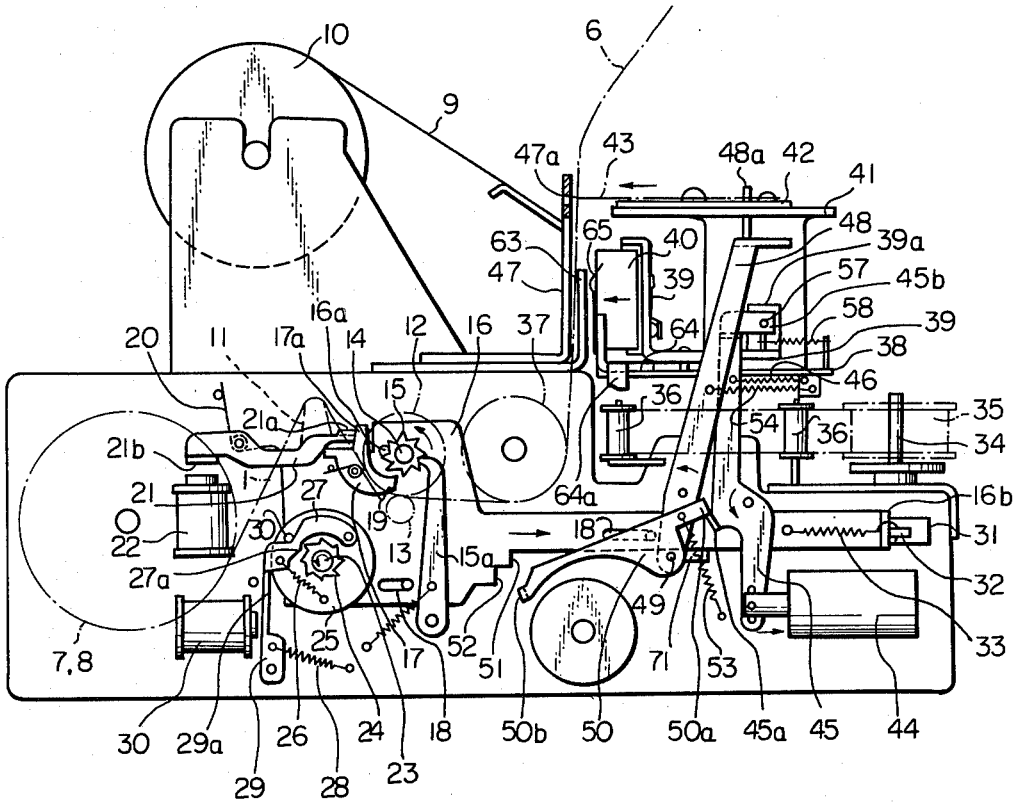
FIG. 2 is a schematic side elevational view of the printer of FIG. 1 incorporating the features of the present invention.

Although the printer of FIG. 2 is shown as having a journal paper printing mechanism in which the above-mentioned printing is performed on a journal paper 9 paid out of a separate journal paper supply roll 9 and then the printed journal paper is wound about a take-up roller 10 as well as the mechanism or performing the printing, stamping and perforated and severing line forming on the receipt paper blank 1 paid out of a supply roll 7 as described hereinabove, since the journal paper printing mechanism itself does not constitute any part of the present invention, description of the journal paper printing mechanism will be omitted herein.

In the printer of FIG. 2, the receipt paper blank 1 paid out of the receipt paper blank supply roll 7 is guided along a guide 11 and then passed through the nip defined by a feed roll 12 and an opposing presser roller 13 as the presser roll 12 rotates in increment whereby the receipt paper blank 1 is advanced in increment by a predetermined amount for the printing of each line of a necessary information and the stamping and perforated and severing line formation. In order to rotate the paper feed roller 12, a ratchet 15 is mounted on the shaft 14 of the paper feed roll 12 and a paper feed pawl 17 is pivoted to a paper and ribbon feed slide plate 16 for engaging and disengaging from the ratchet 15 each time the slide plate 16 makes one reciprocal movement in response to a command from the control circuit (not shown) for the printer as will be described hereinafter. More particularly, when the paper feed pawl 17 engages the ratchet 15 during the outward or rightward movement of the slide plate 16 (as seen in FIG. 2), the pawl 17 rotates the feed roll 12 in increment to thereby feed the receipt paper blank 1 by a predetermined amount.

The slide plate 16 is guided for horizontal movement with respect to the machine frame of the printer by means of a pinslot guide arrangement 18 and the paper feed pawl 17 is adapted to be urged to engage the ratchet 15 by means of a spring 19 and to separate from the ratchet 15 when the arm **17*a* of the paper feed pawl 17 is engaged by one arm 21*a* of a paper feed control lever 21 which is urged in the clockwise direction by means of a spring 20. When an electromagnet 22 is energized for a brief time period by the control circuit, the energized electromagnet 21 attracts the other arm 21*b* of the paper feed control lever 21 to cause the paper feed lever 21 to rock in the counter-clockwise direction against the force of the spring 20 to thereby disengage the arm 21*b* from the paper feed pawl 17 so as to allow the pawl 17 to engage the ratchet 15 whereby the above-mentioned paper feed is performed during the outward or rightward movement of the slide plate 16. As the slide plate 16 moves in the opposite direction or leftwards, the paper feed pawl 17 is arrested by the paper feed control lever 21 and again held in the position disengaged from the ratchet 15. The slide plate 16 is provided with a slot 16***a* to allow the slide plate to move relative to the shaft 14. There is provided a stop lever 15*a* to prevent the ratchet 15 from rotating in the reverse direction.

In order to drive the slide plate 16 in its reciprocal movement, a slide plate operation ratchet 24 is secured to a drive shaft 23 which is in turn secured to the machine frame of the printer to be rotated by the drive source (not shown) of the printer during the operation of the printer. A clutch plate 25 is secured to the drive shaft 23 in coaxial with the ratchet plate operation clutch 24 for free rotation relative to the shaft 23 and a pawl lever 27 is pivoted to the clutch plate 25. The pawl lever 27 is urged toward the axis of the clutch plate 25 by means of a spring 26 and has a ratchet pawl 27*a* on the inner or lower side thereof for engaging the ratchet 24 and the free end 27*b* projecting beyond the outer periphery of the clutch plate 25 by a small distance. The free end 27*b* of the pawl lever 27 is pivoted to the machine frame of the printer and also pivoted to the machine frame adjacent to the free end 27*b* of the pawl lever 27 is a clutch operation lever 29 having the free end 29*a* urged to slide about the clutch plate 25 by means of a spring 28. A stop 25*a* is provided on the clutch plate 25 to be engaged by the pawl lever 27 to hold the clutch plate 25 in such a position in which the free end 29*a* of the lever 29 engages the free end 27*b* of the pawl lever 27 for the clutch plate 25 to thereby hold the pawl lever 27 with the free end 27*b* thereof disengaged from the ratchet 24. The clutch plate 25 is provided with an eccentric cam (not shown) for cooperating with a cam notch formed in the slide plate 16 for receiving the eccentric cam. The eccentric cam is so positioned that while the clutch plate 25 is making one complete rotation from the illustrated position, the eccentric cam causes the slide plate 16 to perform one reciprocal movement in which the slide plate 16 first moves left to right and then from right to left by a predetermined stroke.

In order to impart one complete rotation to the clutch plate 25, an electromagnet 30 is provided for cooperating with the clutch operation lever 29. When the electromagnet 30 is energized by the control circuit of the printer for a brief time period, the energized electromagnet attracts the clutch operation lever 29 to rock the clutch operation lever 29 in the counter-clockwise direction against the force of the spring 28 to disengage the lever 29 from the pawl lever 27 whereby the pawl lever 27 is allowed to rock toward the axis of the clutch plate under the force of the spring 18 to cause the ratchet pawl 27*a* to engage the ratchet 24 which in turn rotates the clutch plate 25 to allow the slide plate 16 to reciprocally move as mentioned hereinabove.

When the clutch plate 25 has finished one complete rotation and the slide plate 16 has completed one reciprocal movement, the electromagnet 330 is deenergized to allow the pawl lever 27 to rock in the clockwise direction to the initial position under the force of the spring 28 whereupon the free end 27*a* of the pawl lever 27 is engaged by the free end 29*a* of the clutch operation lever 29 which is in slidable contact with the clutch plate 25 so as to disengage the clutch lever 27 from the ratchet 24 to allow the clutch lever 27 to rock away from the axis of the clutch plate 25 to the position in which the clutch lever 27 is engaged by the stop 25*a* on the clutch plate to thereby hold the clutch plate in the illustrated position.

A ribbon feed lever 32 abuts against the right-hand end 16*b* of the slide plate 16 and the ribbon feed lever which extends through a slot 31 in the machine frame is normally urged to this abutting position by means of a spring 33 to follow the reciprocal movement of the slide plate 16 to thereby drive a ribbon feed mechanism (not shown) which in turn operates a pair of ribbon spool shafts 34 alternately in the conventional manner. The alternate operation of the pair of ribbon spool shafts 34 passes a ribbon 35 trained about the ribbon spool shafts through guide rollers 36 to a position adjacent to the periphery of a printing wheel 37. Each time either one of the spools on the pair of the spool shafts has the ribbon 35 wound thereabout by a predetermined amount, the movement direction of the ribbon 35 is reversed.

The printing operation on the receipt paper blank 1 is performed in the conventional manner, that is, a printing hammer (not shown) is actuated by a selector lever (not shown) which is selectively operated in response to a printing command from the control circuit so as to strike against the receipt paper blank 1 positioned about the printing wheel 37 with the ribbon 35 interposed between the paper and a character type selected out of a plurality of character types on the printing wheel 37 which is then positioned in the printing position.

As mentioned hereinabove, the stamping operation is selectively performed on the receipt paper blank 1 in timed relation to the printing operation and in order to form the perforated line and/or severing line on the paper blank, a stamping device 40 is supported on a stamping device support plate 39 adapted to be guided on a base plate 38 and a cutting blade 48 is secured to a cutting blade support plate 42 adapted to be guided on a cutting device base plate 41.

The stamping device support plate 39 is designed to be operated from an operation plunger or stamping plunger 44 adapted to be energized by the printer control circuit through an operation lever or stamping lever 45 pivoted to the printer machine frame. The stamping lever 45 is normally urged in the clockwise direction by a spring 46 to hold the stamping device 40 in the inoperative position and when the stamping plunger 44 is energized by the printer control circuit, the stamping lever 45 is caused to rock in the counter-clockwise direction against the force of the spring 46 to move the stamping device 40 toward the receipt paper blank 1 being guided along the support plate 47 to thereby selectively perform the stamping operation on the receipt paper blank 1 as will be described hereinafter.

The cutter blade support plate 42 is interlocked with a paper cutting lever 48 pivoted to the printer machine frame and the support plate 42 is moved by a stroke selectively determined by the reciprocal movement of the slide plate 16 in response to a command from the printer control circuit to thereby form the perforated line on or cut the receipt paper blank 1.

Figure 3:
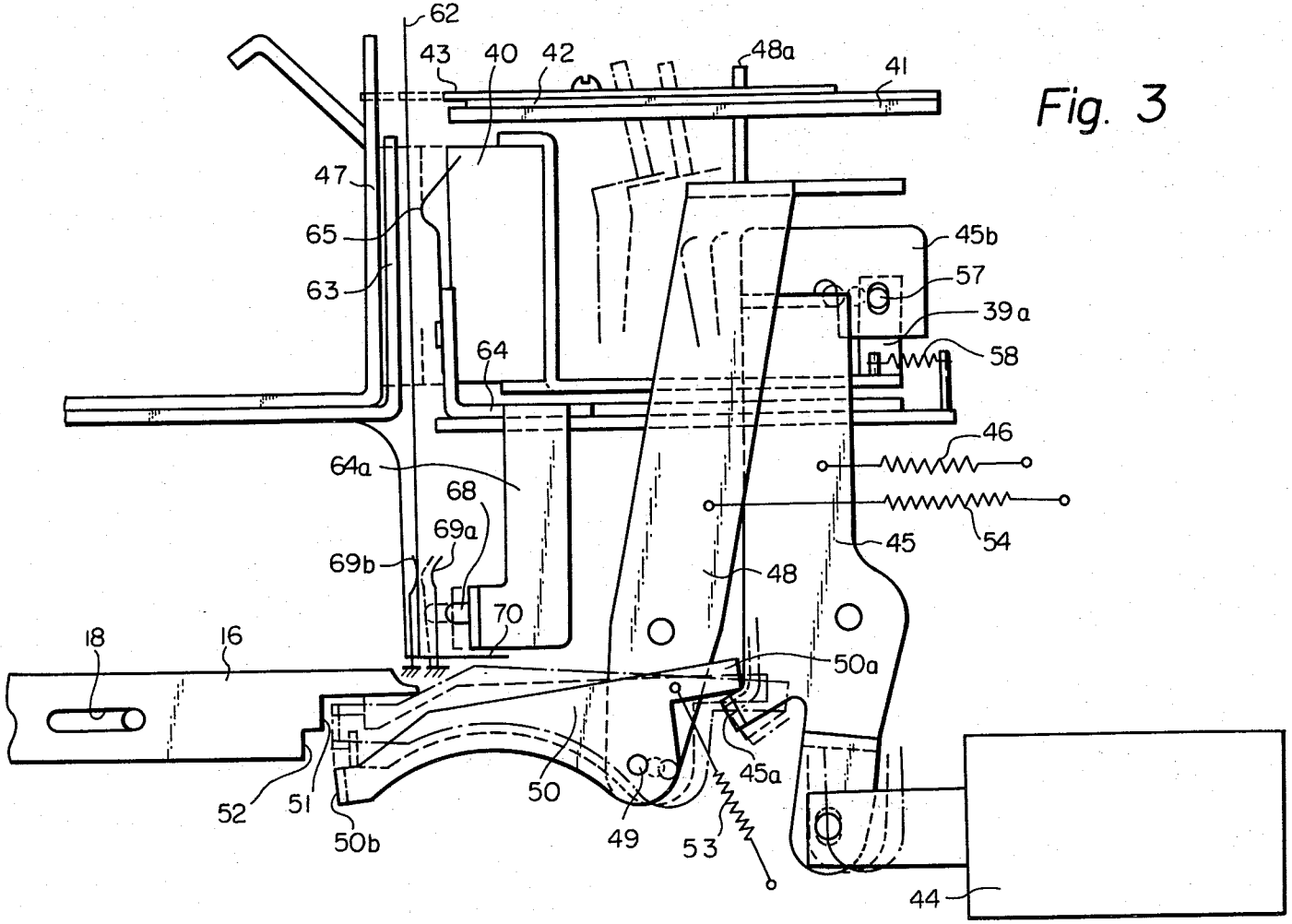
FIG. 3 is a fragmentary side elevational view on an enlarged scale of the printer as shown in FIG. 2.
Figure 4:
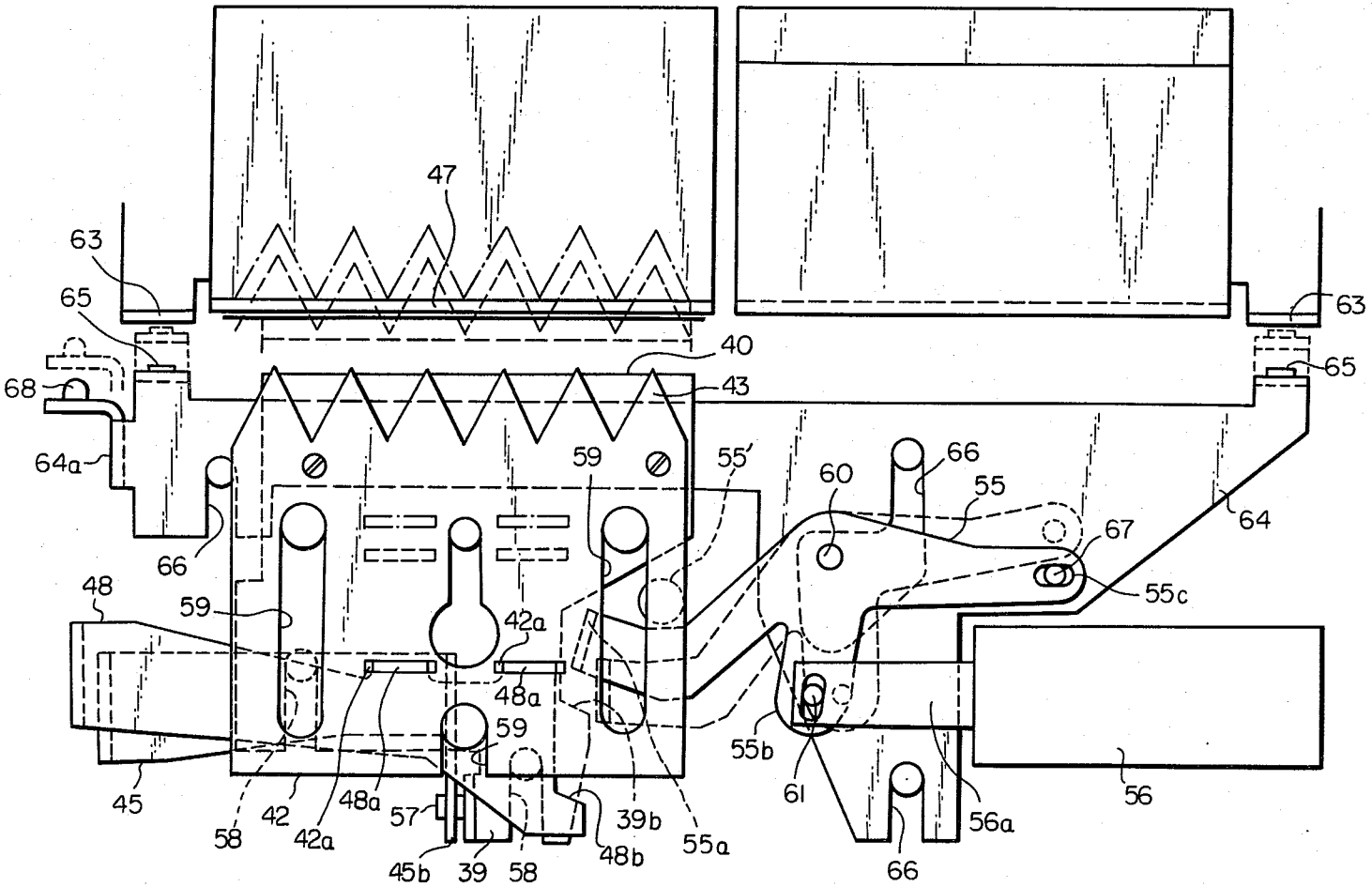
FIG. 4 is a plan view of FIG. 3.

Related operation of the operation mechanisms for the stamping device 40 and cutter blade 43 will be now described in detail referring to FIGS. 2 through 4. The stamping lever 45 is provided with a bent 45*a* adapted to cooperate with one arm 50*a* of a substantially T-shaped slide plate connection lever 50 pivoted to the paper cutting lever 48 by means of a pin 49 and a bent 50*b* on the other arm of the lever 50 is adapted to selectively engage first and second steps 51, 52 on the slide plate 16. The lever 50 is normally urged to cause the bent 50*b* to selectively engage these steps. The paper cutting lever 48 itself is urged in the clockwise direction by means of a spring 54 and held in the illustrated retracted position by the cutter blade support plate 42 which is limited in its movement range by the paper cutting device blade plate 41 with a projection 48*a* at the top of the plate 42 engaging the plate 41. When the stamping plunger 44 in its deenergized condition, the arm 50*a* of the lever 50 is engaged by the bent 45*a* on the stamping lever 45 to hold the lever 50 in a rocked position in the counter-clockwise direction, hold the bent 50*b* at the inner end of the lever 50 away from the steps 51, 52 on the slide plate 16 and hold the slide connection lever 50 independent of the reciprocal movement of the slide plate 16 whereby the paper cutting lever 48 and accordingly, the cutter blade 43 is held in the inoperative position.

When the stamping plunger 44 is energized, the stamping lever 45 is rocked in the counter-clockwise direction to move the bent 45*a* downwardly and thus, the slide plate connection lever 50 is rocked in the clockwise direction under the force of the spring 53. However, the rocking movement range of the stamping lever 45 in the counter-clockwise direction is selectively controlled by a switching lever 55 (FIG. 4) depending upon whether the stamping or perforated line formation operation is performed in conjunction with the paper cutting operation as will be described hereinafter. When both the stamping and paper cutting are performed, the switching lever 55 is rocked in the counter-clockwise direction to the retracted position upon the energization of the switching plunger 56 and thus, the switching lever 55 is allowed to rock throughout the full rocking stroke to advance the stamping device 40 to cause the device to stamp on the receipt paper blank 1 supported on the support plate 47 and the slide plate connection lever 50 is allowed to rock in the clockwise direction by a great distance until the bent 50*b* of the lever engages the first step 51 on the slide plate 16. Since the first step 51 is positioned rightwardly of the second step 52, the lever 50 is moved rightwardly by a great distance as the slide plate 16 is reciprocally moved to thereby rock the paper cutting lever 48 in the counter-clockwise direction by a great distance against the force of the spring 54 and move the cutter blade support plate 42 which is in engagement with the upright projection 48*a* on the lever 48 leftwards by a great distance together with the cutter blade 43 until the cutting edge of the cutter blade passes through a groove 47*a* in the support plate 47 so as to cut the receipt paper blank 1.

When only the perforated line formation operation is performed eliminating the stamping operation, similarly, the stamping plunger 44 is energized to rock the stamping lever 45 in the counter-clockwise direction. However, in this case, by the deenergization of the switching plunger 56, and engaging shoulder 39*b* on the stamping device support plate 39 having a bent 39*a* pivoted to the bent 45*b* at the upper end of the stamping lever 45 by means of a pin 57 is engaged by an engaging arm 55*a* on the switching lever 55 held in the positioned rocked in the clockwise direction by a stop 55' (the solid line position in FIG. 4) to limit the advance stroke of the stamping device support plate 39 whereby the stamping on the receipt paper blank 1 by the stamping device 40 is prevented and the rocking range of the slide connection lever 50 in the clockwise direction is also limited and the bent 50*b* on the lever 50 is engaged by the second engaging step 52 on the slide plate 16. Since the second engaging step 52 is positioned leftwardly on the first engaging step 51, as the slide plate 16 moves rightwards, the paper cutting lever 50 is rocked through the lever 50 in the counter-clockwise direction by a smaller distance than that covered by the rocking movement described hereinabove and the engaging shoulder 48*b* on the horizontal bent at the upper end of the paper cutting lever 48 is engaged by the engaging arm 55*a* on the switching lever 55 to limit the advance stroke of the cutter blade 43 and prevent the cutting of the receipt paper blank 1 by the cutting blade 43 whereby only the perforated line formation operation is performed.

Details of the constructions of the various components for performing the above-mentioned operation procedure will be now described referring to FIG. 4. The stamping device support plate 39 is guided for back and forth slidable movement with respect to the base plate 38 by means of a pin-slot guide arrangement 58 and pulled backwardly by the force of the spring 58 as seen in FIG. 3.

And as shown in FIG. 4, the cutter blade support plate 42 is guided for back and forth slidable movement with respect to the base plate 41 by means of a pin-slot guide arrangement 59. The upright projection 48*a* on the paper cutting lever 48 is received in a groove 42*a* in the support plate 42 so that the support plate 42 is moved back and forth as the paper cutting lever 48 rocks.

The switching lever 55 has a substantially T-shape and is pivoted in the center thereof to the machine frame by means of a pivot pin 60 as shown in FIG. 4 and the lever 55 further has a downwardly extending arm 55*b* pivoted to the operation rod 56*a* of a switching plunger 56 by means of a pin 61.

In FIG. 4, the switching lever 55 is held in the rocked position (shown by the dotted line) when the switching plunger 56 is energized and disengaged from the engaging shoulder 48*b* on the paper cutting lever 48 and the engaging shoulder 39*b* on the stamping device plate 39. When the stamping plunger 44 is energized, the stamping lever 45 is rockable to the chain line position to rock the slide plate connection lever 50 to the chain line position until the lever engages the first engaging step 51. Thus, as the slide plate 16 moves rightwards, the paper cutting lever 48 is rockable to the chain line position to thereby allow both the stamping and paper cutting operations to be performed. And when the switching plunger 56 is in its deenergized condition, the switching lever 55 is in the solid line position in which the engaging shoulders 48*b* and 39*b* on the paper cutting lever 48 and support plate 39, respectively, interengage as seen in FIG. 4. When the stamping plunger 44 is energized, the stamping lever 45 is allowed to rock to only the broken line position as seen in FIG. 3 so as to prevent the stamping operation and the slide plate connection lever 50 rocks to the broken line position as seen in FIG. 3 to engage the second engaging step 52 on the slide plate 16. As the slide plate 16 moves rightwards, the paper cutting lever 48 is rocked to the broken line position to advance the cutter blade support plate 42, but the paper cutting lever 48 is engaged by the switching lever 55 at the engaging shoulder 48*b* to thereby precisely advance the paper cutting lever 48 to the perforated line forming position on the receipt paper blank 1.

In the embodiment described hereinabove, as the drive source, a motor is employed, for example, but a solenoid mechanism may be also employed as the drive source. And the slide plate 16 can be driven from a separate drive source.

A further feature of the present invention is that in a prior art printer, when the paper is cut or the perforated line is formed on the paper, as the cutter blade 43 enters the slit 47*a*, a sagging portion or portions of the receipt paper blank tend to enter the slit following the advancing cutter blade resulting in trapping of the cutter blade in the slit and thus, when the cutter blade operation lever 48 is rocked in the clockwise direction under the force of the spring 54 as the cutter blade 43 retracts out of the slit 47*a*, the force of the spring 54 is insufficient to rock the cutter operation lever 48 to thereby make it impossible to perform the paper feed and paper cutting or perforated line formation for the next printing cycle, but such disadvantages can be overcome by a means according to the present invention.

In order to ensure positive rocking movement of the cutter operation lever 48 in the return stroke, it may be, of course, proposed to increase the force of the spring 54, but in such case, it is necessary to rock the cutter operation lever 48 against the increased force of the spring 54 in the advance stroke in order to advance the cutter blade 43 and thus, an increased driving force and a high power are required resulting in a large size printer. Therefore, increased driving force and high power are not suitable for a small size printer.

The above-mentioned clogging by the sagging portion or portions of the paper can be eliminated by the utilization of the force provided as the slide lever 11 moves in the return stroke or leftwards by a means having a simple construction. As mentioned hereinabove, since the slide plate 16 is selectively connected to the drive shaft 23 adapted to be continuously rotated by the eccentric cam for reciprocal movement, the force provided by the reciprocal movement of the lever 16 is too great for mulfunction.

More particularly, in the present invention, the slide lever 16 is provided with an engaging portion or bent piece 71 for engaging the right-hand side of the cutter operation lever 48 and/or slide connection lever 50.

By the provision of such bent piece 71, when the slide connection lever 50 is selectively operated by the first step 51 or second step 52 on the slide lever 16 for movement rightwards in the cutting of the receipt paper blank or the formation of the perforated line on the paper blank, the bent piece 71 is, of course moved rightwards together with the slide lever 16 and thus, the operation of the cutter operation lever 48 and the slide connection lever 50 is not affected in any way. When the cutter operation lever 48 is about to rock in the clockwise direction to the retracted position under the force of the spring 54 at the termination of the paper cutting or perforated line formation operation, even if the cutter blade 43 remains in the slit 47*a* in the trapped condition therein and the cutter operation lever is blocked from rocking, the return or leftward movement of the slide lever 16 positively pushes the cutter operation lever 48 and/or slide connection lever 50 by means of the bent piece 71 on the lever 16 to thereby forcibly rock the cutter operation lever 48 in the clockwise direction whereby the cutter blade 43 is positively retracted out of the slit 47*a* and thereafter, the retraction of the cutter blade 43 is accelerated by the force of the spring 54 to thereby positively prevent the clogging of the slit with the paper.

In the present invention, the control circuit is so designed that a single bill paper blank 62 fed into the printer is printed a total sum thereon, for example, other than the printing on a rolled receipt paper blank as mentioned hereinabove.

For the purpose, bill blank support plates 63 are secured to the opposite sides of the stamping device support plate 47 and the leaf spring 65 of a bill blank holding-down lever 64 is provided in opposition to the support plates 63 in abutment against the support plates to support and guide the bill paper blank 62 a stabilized condition.

The holding-down lever 64 is guided for back and forth slidable movement by means of a pin-slot guide arrangement 66 and the movement of the holding-down lever is effected by the utilization of the switching plunger 56 for the stamping and paper cutting operations. For the purpose, a pin 67 on the holding-down lever 64 engages in a slot 55*c* in the other arm of the switching lever and the switching plunger 56 is energized in response to a single bill blank printing command from the control circuit whereupon the switching lever 55 is rocked in the counter-clockwise direction to advance the holding-down lever 64 to urge the spring 65 on the lever 64 against the support plates 63 and thus, the bill paper blank is held in a stabilized condition for printing.

Furthermore, in the present invention, in order to prevent any erroneous printing on the bill paper blank when the bill paper blank is not inserted in a proper printing position in the printer, depending bent piece 64*a* is attached to one side of the holding-down lever 64 and a projection 68 is provided on the depending bent piece 64*a*. Thus, when the holding-down lever 64 advances, the projection 68 pushes a movable contact 69*a* of a detection switch to cause the movable contact to engage a stationary contact 69*b* of the detection switch to thereby close the circuit of the detection switch.

The detection switch is electrically connected to the control circuit and designed to prevent the printing operation when the switch is closed.

The lower edge of the bill blank 62 is adapted to abut against an abutment 70 when the bill paper blank is inserted into a proper printing position. The detection switch is positioned adjacent to the abutment 70 and the bill paper blank 62 is adapted to be inserted into between the contacts 69*a*, 69*a*.

Thus, only when the bill paper blank 62 is positioned in the proper printing position with the lower edge of the bill paper blank in abutment against the abutment 70, the bill paper blank is positioned between the contacts 69*a*, 69*b* and thus, when the holding-down lever 64 advances to the printing position, the detection switch is prevented from closing by the insulative nature of the bill paper blank 62 to thereby make it possible to perform printing on the bill paper blank.

Figure 5:
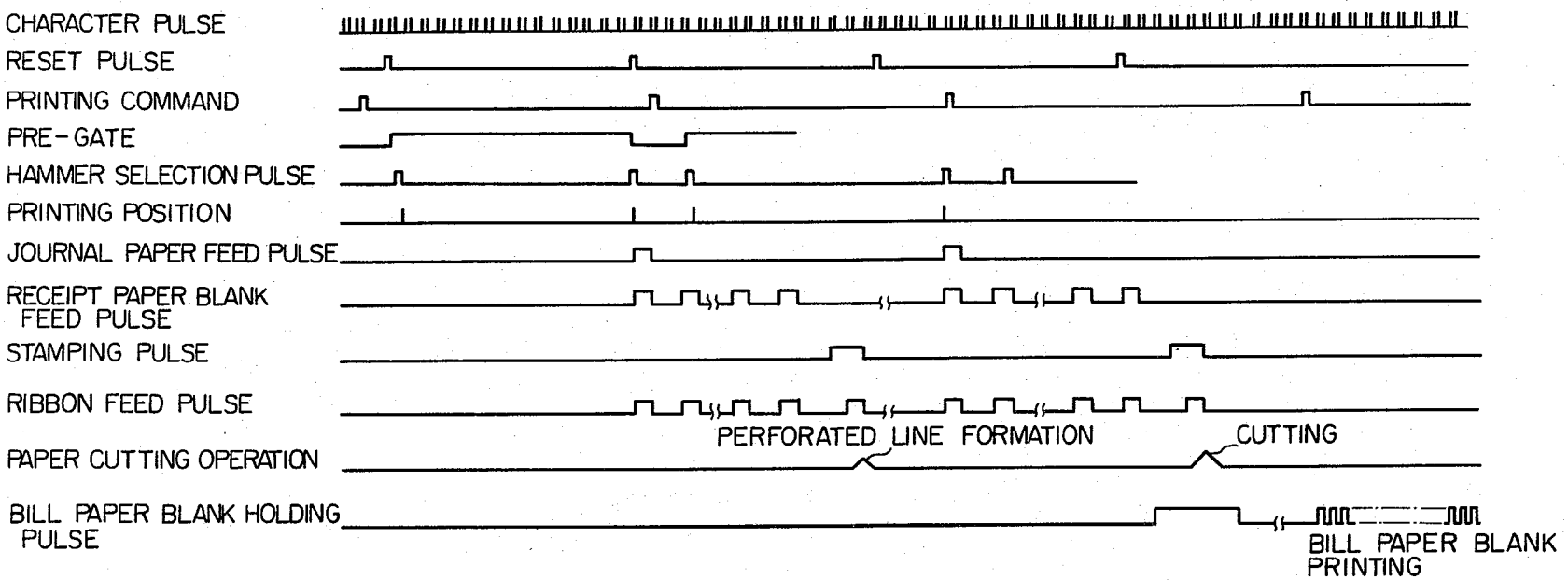
FIG. 5 is a timing chart showing the operation sequence of the printer of the invention.

The operation sequence of the various components of the printer described hereinabove is briefly described referring to FIG. 5. When the printer is started, the drive motor (not shown) is energized and a character pulse is provided to the control circuit for operating the components of the printer in a predetermined sequence. A reset pulse is produced for each predetermined printing cycle. When the operator gives a printing command, the pregate of the control circuit is opened after a predetemined character pulse has been produced and a printing is performed on the area of the receipt paper blank following the stamp receiving area of the paper blank already stamped by a selected character type of the printing wheel rotating in response to a predetermined hammer selection pulse until a reset pulse is produced and each time the printing for one line of a necessary information has been completed, the electromagnets 30 and 22 are energized for a brief time period in response to a command from the control circuit to thereby feed the receipt paper blank and ribbon in increment. At the moment when the printing for one line of the necessary information has been completed, journal paper feed, receipt paper blank feed and ribbon feed signals are produced to repeat the same printing operation sequence in response to successive commands from the control circuit. While repeating the printing operation sequence, receipt paper blank feed ribbon feed pulses are produced for each printing cycle to energize the electromagnets 30 and 32.

After a predetermined number of lines of the necessary information have been printed on the receipt paper blank, when the area of the receipt paper blank where the perforated line is to be formed is positioned in the position in alignment with the cutter blade, a stamping pulse is produced to energize the stamping plunger 44. In this case, no receipt paper blank holding-down pulse for energizing the switching plunger 56 is produced and thus, the stamping operation is prevented and the cutter blade is operated to form the perforated line on the receipt paper blank.

Next, a receipt paper blank feed pulse is produced to advance the stamped area of the paper blank so as to position the area to be formed with the severing line to the position of the cutter blade whereupon a stamping pulse is produced. Prior to the producing of the stamping pulse, a receipt paper blank holding pulse is produced so as to retract the switching lever and thus, the stamping device and cutter blade are caused to advance throughout the entire stroke to perform the stamping and cutting operations, respectively.

When a single bill paper is to be printed, the bill paper blank holding-down pulse is provided to the switching plunger as an interrupted pulse, but the bill paper blank holding-down force is still properly maintained.

While only one embodiment of the invention has been shown and described in detail, it will be understood that the same is for illustration purpose only and not to be taken as a definition of the invention, reference being had for this purpose to the appended claims.

We claim:

1. In a printer having a slide member adapted to be reciprocally moved by a drive source, the improvement comprises a paper cutting mechanism including a paper cutting member having a cutter blade for reciprocal movement relative to a printed paper for cutting said paper, a connection member supported on said paper cutting member and disposed to engage and disengage from said slide member and an electromagnetic means for controlling the engagement and disengagement of said connection member with respect to said slide member, whereby when said electromagnetic means is operated in response to a paper cutting signal, said connection member is caused to engage said slide member to operate the slide member which in turn operates said paper cutting member.

2. In a printer having a slide member adapted to be reciprocally moved by a drive source, the improvement comprises a paper cutting and perforated line formation mechanism including an operation member adapted to be operated by an electromagnetic means, a paper cutting member having a cutter blade and capable of assuming a first position for cutting a printed paper and a second position for forming a perforated line on said printed paper and a connection member connected to said paper cutting member and controlled by said operation member to engage said slide member so as to move the cutting member between said first and second positions, the position of said connection member being controlled by said operation member to transmit a substantial amount of the movement of said slide member so as to move said paper cutting member to said first position for cutting said printed paper and to transmit a minor amount of the movement of the slide member so as to move the paper cutting member to said second position for forming said perforated line on the printed paper.

3. The printer according to claim 2, wherein said operation member is provided with a stamping device, said operation member being movable between a stamping position in which said stamping device is in abutment against said printed paper and a non-stamping position, the position of said connection member being controlled by said operation member so as to be engaged by said slide member for permitting said paper cutting member to move said first or second position, and a switching member adapted to limit the range of movement of said operation member to thereby limit the range of movement of said slide member so as to move the paper cutting member and operation member to said second position and non-stamping position, whereby when said operation member is not limited in the movement range, said paper cutting member and operation member are allowed to move to said first and stamping positions.

* * * * *